US005586474A

United States Patent [19]

Lund

[11] Patent Number: 5,586,474

[45] Date of Patent: Dec. 24, 1996

[54] TORQUE TRANSFER TOOL

[75] Inventor: David R. Lund, Charleston, S.C.

[73] Assignee: Victory in Jesus Ministries, Inc., Summerville, S.C.

[21] Appl. No.: 284,080

[22] Filed: Aug. 1, 1994

Related U.S. Application Data

[63] Continuation-in-part of Ser. No. 75,787, Jun. 14, 1993, abandoned.

[51] Int. Cl.[6] ..... B25B 17/00

[52] U.S. Cl. ..... 81/57.3; 81/57.43; 81/57.14

[58] Field of Search ..... 81/57.13, 57.14, 81/57.3, 57.43

[56] References Cited

U.S. PATENT DOCUMENTS

| | | | |
|---|---|---|---|
| 2,672,065 | 3/1954 | Danuskie | 81/57.3 |
| 3,138,983 | 6/1964 | Frizzell | 81/57.3 |
| 3,714,852 | 2/1973 | Giangrasso | 81/57.3 |
| 4,827,809 | 5/1989 | Broemel | 81/57.3 |

*Primary Examiner*—James G. Smith

*Attorney, Agent, or Firm*—B. Craig Killough

[57] ABSTRACT

A torque transfer device allows torque to be input at one point of the device and transferred to another point of the device at which the power or torque can be taken from the device. The device incorporates a direct drive means comprised of links and spacers which are interconnected by a continuous loop, such as a cable. The direct drive means drives gears which are constructed to receive the links and spacers.

30 Claims, 11 Drawing Sheets

TORQUE TRANSFER TOOL

This application is a continuation-in-part of application Ser. No. 08/075,787, Jun. 14, 1993 abandoned.

FIELD OF THE INVENTION

This invention relates to a device for transferring torque by continuous loop direct drive means which transfers torque from a first drive gear to a second drive gear, and is particularly directed to a device for the transfer of relatively high torque within a confined space, or where the device is enclosed in a relatively small housing.

BACKGROUND OF THE INVENTION

There are many devices which transfer torque, or rotational velocity, from one point to another. Chains, belts and similar direct drive means transfer rotational movement from one gear or pulley or similar drive means to a second or subsequent gear or pulley or similar driven means.

In some applications, it is desirable to transfer relatively high torque from one point to another point, or from one device to another device. In such applications, space limitations or considerations may be a factor. The relatively high torque to be transferred may preclude the use of small torque transfer devices.

An example of such space limitations are torque transfer devices which are placed within enclosures. Examples of devices which transfer relatively high torque are tools which are used to tighten fasteners by the application of torque.

Various wrenches, extensions, ratchets, adapters and power transfer tools and devices are disclosed in the prior art. Similarly, camshafts and similar devices are driven by the application of relatively high torque where space for the application of the drive means is limited. Problems are encountered with such devices where the devices are enclosed in relatively small housings, or are otherwise required to be relatively compact in comparison to the torque to be transferred. Common problems experienced with the devices of the prior art include friction and wear between the housing of the device and the drive means, inadequate strength of the drive means or gears, and inadequate or improper engagement of the drive means and the gears due to space limitations.

SUMMARY OF THE PRESENT INVENTION

The present invention is a device which transfers torque from one point to a second remote point of the device. A drive means or drive tool inputs torque into the device at a first point, and the rotational movement, and torque, is taken, or harvested, from the second remote point. Typically, the transfer of the rotation by the tool will be along a path of travel which is not on the same axis as the rotation of the drive tool.

The present invention incorporates a direct drive means which connects a first drive gear to a second drive gear. As the first gear is rotated as torque is applied to the first gear, the direct drive means is engaged by the first gear and the direct drive means engages the second drive gear, causing it to rotate.

The direct drive means is a series of links and spacers. The links and spacers together are connected by a continuous loop cable to form a continuous loop. The cable runs through the links and spacers to join them together, but the cable is not fixed to the links and spacers. Rotation of the direct drive means is accomplished and torque is transferred by the links and spacers abutting each other, and only minimally by means of the cable. This structure results in the links being able to rotate relative to the cable and act as bearings, and virtually eliminates the likelihood of the cable breaking, since the force applied to the cable is minimal.

The use of links having a spherical or partially spherical surface improves the engagement of the direct drive means with the gears as desired, but aids in reducing friction at other points of the device, such as within a housing for the device, where such energy loss is undesired. The use of spacers which are designed to pivot relative to each other and relative to the links as they are taken up for rotation through the gears.

DESCRIPTION OF THE PREFERRED EMBODIMENT

The present invention is characterized by a drive means which is driven by a drive gear, or pulley, or similar rotational device, which, in turn, drives a drive gear, a pulley, or a similar rotational device. The drive means then transfers torque from a first rotating member to a second, or perhaps subsequent, rotating member.

The drive means is a series of links and spacers. The links engage the drive gear or other rotational member. The spacers maintain proper spacing between the links.

The links and spacers are connected by a continuous loop. This continuous loop is referred to herein as a cable. A continuous loop could be a cable which is comprised of multiple strands of material, or the cable could be a single strand of material which forms a continuous loop. It is preferred that the cable exhibit substantially no elasticity under load, such as when torque is applied to the drive gears. The continuous loop, or cable, should exhibit high strength and low to no elasticity under load.

A characteristic of the drive means of the present invention is that none of the links or spacers is affixed or attached to the cable. The links and spacers are joined in the desired sequence by means of the cable running through the links and spacers, but the cable is not attached to any of the links or spacers. In this way, the links and spacers can flex or pivot freely as the drive means changes angular direction as it rotates through the drive gears, or travels through casings in which the device is housed, or traverses idler gears, if used.

The use of a cable which is "free", that is, not affixed or attached to the links or spacers, is common to all embodiments of the device. This feature allows the drive means to be comprised of links or spacers which are not affixed to the cable, and are not affixed or attached to each other. This is in contrast with the drive means of the prior art, such as bicycle chains, wherein each link is fixed or attached to the adjacent link. The present invention allows greater freedom of movement of the links and spacers relative to each other, which is necessary to achieve a desired goal of the device, which is the application of relatively high torque using a drive means which is relatively small and is designed to work in a relatively confined space.

Also common to each of the embodiments is a link having a rounded or arcuate surface which minimizes friction as this surface of the link contacts a housing or other similar environment in which the drive means is operating. In each of the embodiments as shown, a spherical or partially spherical link is used, with the spherical or rounded portion of the link contacting the housing or other environment, if necessary, to reduce friction as the drive means traverses the device. Each of the embodiments presents a link which has specific advantages in this regard.

Figure 1:
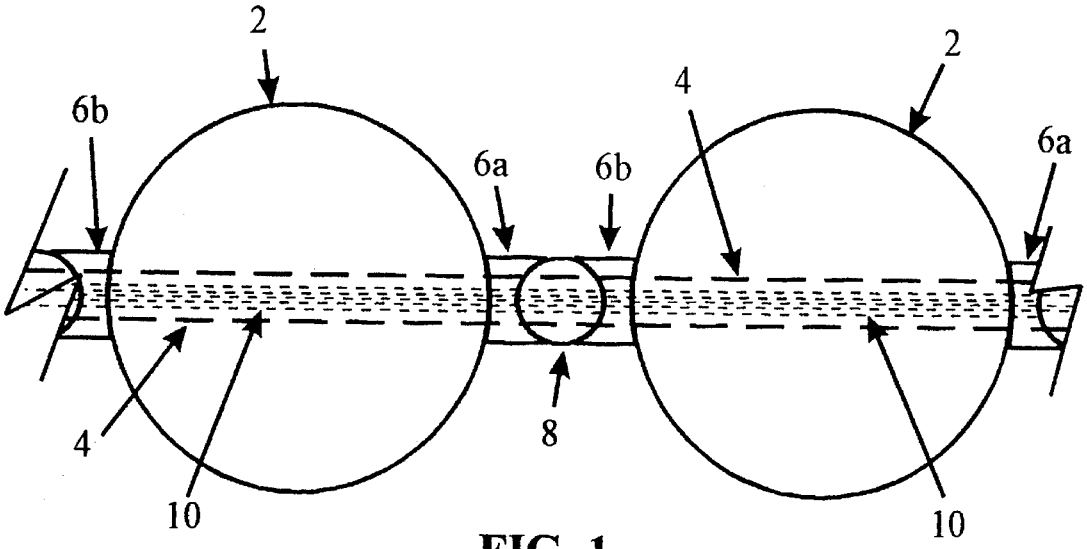
FIG. 1 is an enlarged partial view of an embodiment of a direct drive means showing a cable as a phantom.

Referring now to the drawing figures, FIG. 1 discloses a first embodiment of the drive means. This embodiment uses spherical links 2 having a straight hole or void 4 drilled or formed through the center of the sphere. A spacer 22 is used to maintain the links at the desired distance from each other. In the embodiment shown in FIG. 1, the spacer actually comprises three joints. Two of the joints *6a,6b* are identical to each other, having an concave surface on one end which is of a radius approximately equal to the radius of the sphere, so that the end of the spacer engages the sphere and provides a bearing surface between the spacer and the sphere.

The opposite end of joints *6a,6b* has a concave surface of a radius which is generally the same as joint 8, which has a convex or circular surface which engages the joints *6a,6b*. The spacers have a void there through which allows cable 10 to connect the links and the spacers as shown in FIG. 1, by running through the links and the spacers, with the spacers engaging the links and in the joints as shown in FIG. 1.

Figure 2:
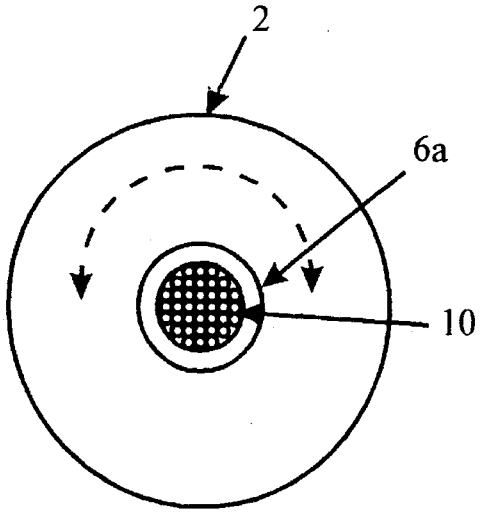
FIG. 2 is a sectioned view of a direct drive means taken through a spacer.
Figure 3:
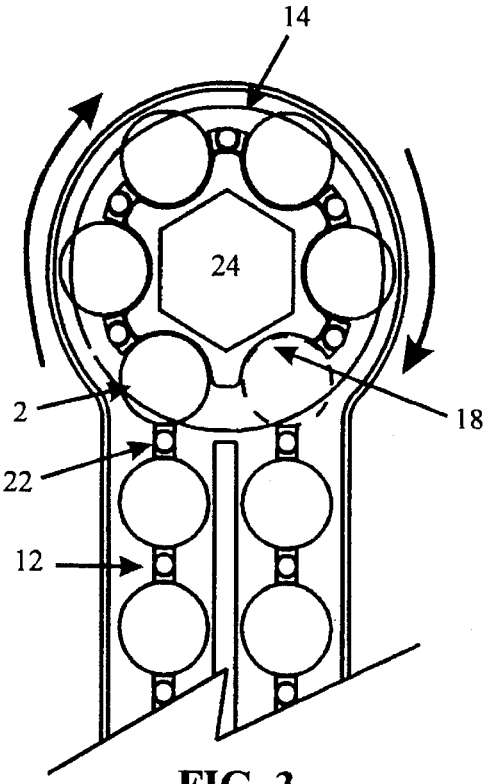
FIG. 3 is an enlarged partial view of a torque transfer device.
Figure 4:
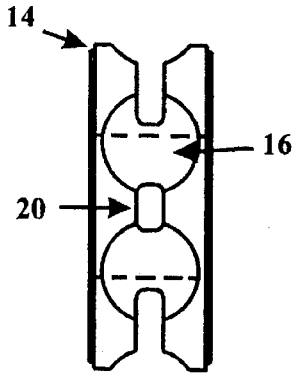
FIG. 4 is a side elevation of a drive gear.

FIG. 2 demonstrates the cable as it extends through the links and the spacers. As indicated by the arrows, the link is free to rotate relative to the cable, since the link is not fixed or attached to cable.

FIG. 3 through 6 demonstrate the drive means 12 as it rotates through a drive gear 14. The drive means is shown as a continuous loop in FIG. 7. This continuous loop drive means is formed by a series of links and spacers comprised as set forth above. The cable is designed to be of a length which matches the number of links and spacers to be used, so that the links and spacers fill the cable in the desired repetitive pattern of links and spacers.

It is preferred that the drive gear used with the device be configured to match the series of links and spacers. When the spherical links of the embodiment as shown in FIGS. 1 through 9 is used, the drive gear will have voids 16 which are generally circular when viewed as in FIG. 4. The voids will be larger than the links so that the links can engage and protrude into the voids. It is desired that the bottom 18 of the void have an arcuate surface which generally matches the surface of the sphere for complete engagement of the link within the void of the drive gear.

Figure 5:
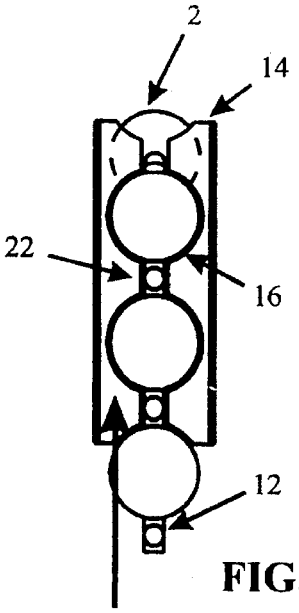
FIG. 5 is the elevation of the drive gear of FIG. 4 demonstrating a direct drive means rotating through the drive gear.
Figure 6:
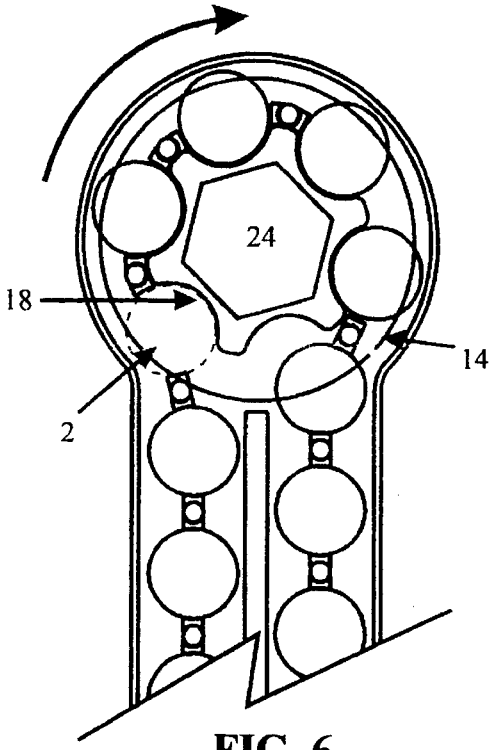
FIG. 6 is an enlarged partial view of the device, with a direction of rotation indicated.

It is preferred that the drive gear is configured so that the sphere is completely engaged within the drive gear. The link will engage into the void so that the top of the link does not extend beyond the outside diameter of the drive gear. FIG. 5.

In the preferred embodiment, the drive gear also comprises a continuous orifice 20 into which the spacers 22 are engaged. This orifice allows the links to fully engage the drive gear 14 as shown in FIG. 5. It is also desired that the voids match the point of power application to, or power take off from, the gears to minimize the size of the gears, and therefore the overall size of the device. For example, as show in FIG. 3, a hexagonal void 24 is provided in the center of the drive gear which allows engagement of a hexagonal shaft for applying torque to the gear, or taking torque from the gear. Accordingly, such voids are provided, each positioned over the flat spot, or hexagonal side, of the hexagonal drive to minimize the overall size of the gear. If space is not at a premium when using the device, a larger gear may be used for the purpose of achieving a mechanical advantage.

Figure 7:
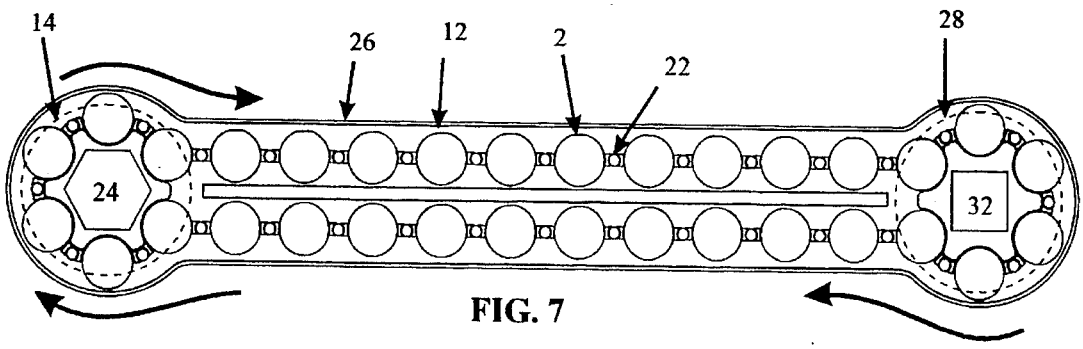
FIG. 7 is a top plan view of the device located in the housing, with arrows demonstrating a direction of rotation of the device.
Figure 8:
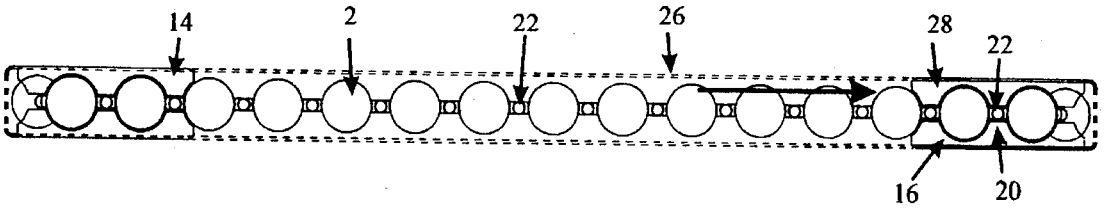
FIG. 8 is a side elevation of the torque transfer device, enlarged from FIG. 7, and showing a housing as a phantom.

FIG. 7 shows an embodiment of the device as enclosed in a housing 26. The direction of rotation is indicated by the arrows. Power is applied at one gear, and taken off at an opposite gear. By way of example, a rectangular drive 32 is used in conjunction with one drive gear 14, while a hexagonal void 24 is used on the opposite gear 28. The device as shown in FIG. 7 could be a tool which is used to transfer torque in a horizontal plane.

Figure 9:
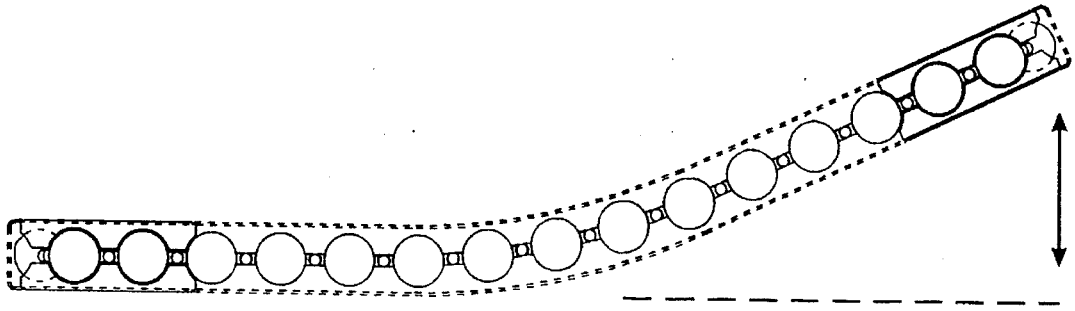
FIG. 9 is a side elevation of the direct drive means device.

As shown in FIG. 9 the housing of the device could be flexible. The use of a particular drive means allows the device to be flexed, by means of the cable which is independent of the links and spacers, and by means of the engagement of the joints of the spacers, and the links.

Figure 10:
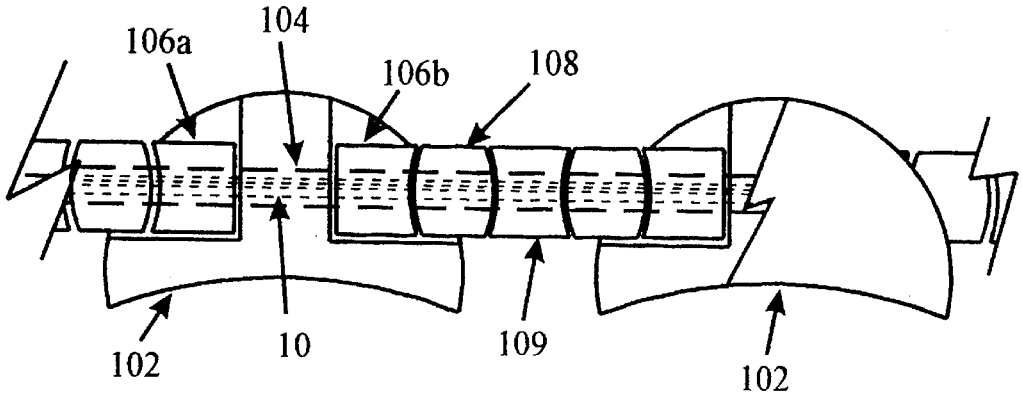
FIG. 10 is an enlarged partial view of an embodiment of a direct drive means showing a cable as a phantom.
Figure 11:
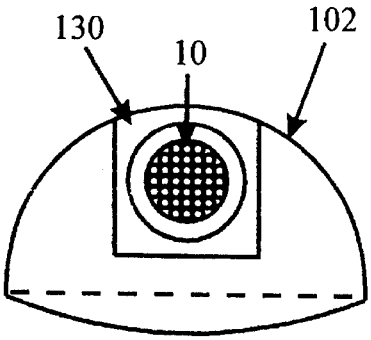
FIG. 11 is a sectioned view of a direct drive means taken through a spacer.
Figure 12:
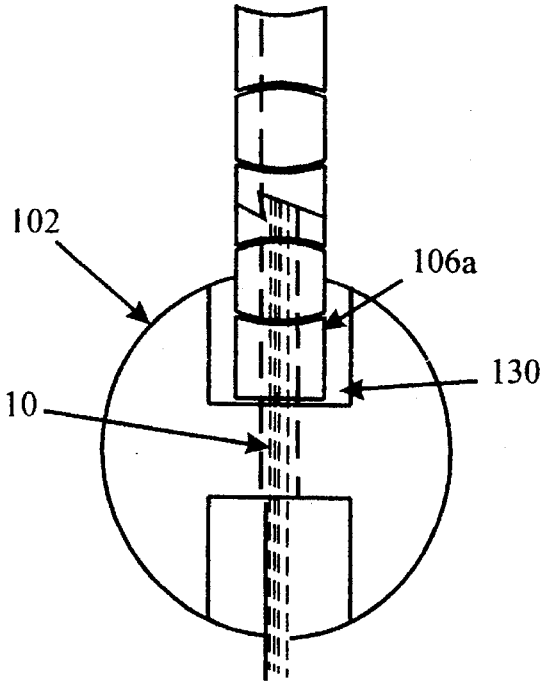
FIG. 12 is a top plan view of a link and a spacer, with a cable shown partially as a phantom.
Figure 13:
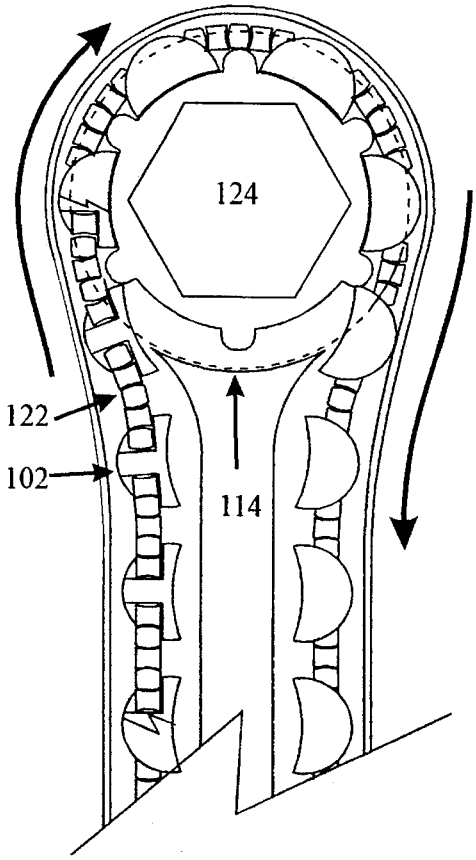
FIG. 13 is an enlarged partial view of a direct drive means.

An additional embodiment of the device is shown in FIG. 10. Again, cable 10 joins the series of links 102 and spacers. The cable is independent of the links and spacers, in that, as is consistent with the invention, the cable is not attached to the links and spacers, but runs through the links and spacers to join the links and spacers. Spacers are used to hold the links at the desired spacing or interval.

The embodiment of FIG. 10 is used when space is at a premium, and space limitations are great. The links in this embodiment are truncated spheres. The links have an upper surface which forms part of a sphere, but the sphere is cut away or otherwise truncated on the lower portion to reduce the overall size of the link. This shape could be called partially spherical or semi spherical. In the embodiment shown in FIGS. 10 through 18, the resulting shape of the link, when viewed as shown in FIG. 10, could be described as a half moon shape, which gives the advantages of the rounded upper surface, and also engages the voids of drive gears in a desirable manner by extending the leading and trailing surface of the link beyond that of a hemispherical shape. The rounded, or concave, lower surface generally matches the radius of the gear at the point of engagement for space efficiency.

The link has a void 104 formed in an upper surface of the link. The void could have a relatively flat surface 130 where joint of the spacer abuts the link. The joints 106*a*,106*b* of the spacer which abut the link could have a flat surface, or the link and the joint could have corresponding curved surfaces similar to those shown in FIG. 1. For ease of manufacturing, a flat surface is demonstrated where the joint of the spacer abuts the link.

The spacers may have additional joints. These joints may be an alternating and corresponding convex and concave shapes to provide a bearing surface for the device. As shown in FIG. 10, joint 109 has concave surfaces on each end, with the next joint 108 having convex surfaces on each end. The joints have corresponding radii so as to provide a bearing surface between the joints. The cable extends through the joints as shown, but is not connected to any of the joints.

Figure 14:
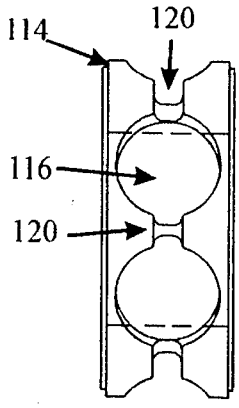
FIG. 14 is a side elevation of a drive gear.
Figure 15:
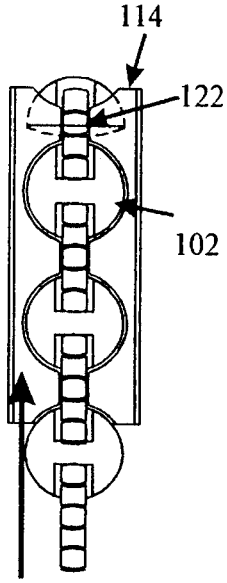
FIG. 15 is the elevation of the drive gear of FIG. 14 demonstrating a direct drive means rotating through the drive gear.

The use of the truncated spherical links allow an even more compact device, while retaining the high strength and characteristics of the device. Again, drive gears 114,128 are matched to the device. Voids 116 which are generally circular when viewed as in FIG. 14, are provided within the gear for engagement of the links as shown in FIG. 15. An orifice 120 is provided which engages the spacers 122.

Figure 16:
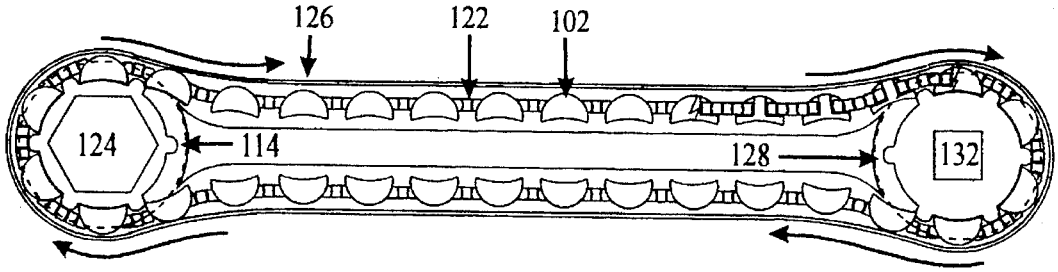
FIG. 16 is a top plan view of the device located in the housing, with the arrows demonstrating a possible direction of rotation.
Figure 17:
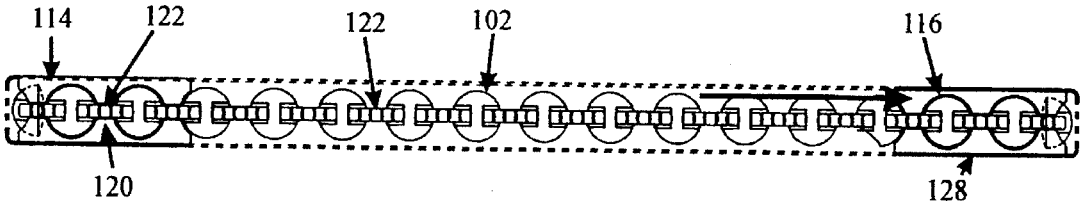
FIG. 17 is a side elevation of the torque transfer device, enlarged from FIG. 16, and showing a housing as a phantom.

When FIG. 16 is compared with FIG. 7, it can be seen that hexagonal void 124 and the rectangular drive 132 are relatively larger than FIG. 16. This indicates that the space occupied by the drive means is less than the space occupied by the drive means shown in the embodiment of FIGS. 1 through 9. The center of the sides of the hexagon which make up void 124 are roughly matched to the center of the voids 116 which engage the links, for maximum space efficiently where an overall minimal size of the drive gear is desired. It is again noted that the links do not extend beyond the outside circumference of the gears in the preferred embodiment, when the links are engaged within the voids as shown. FIG. 15.

Figure 18:
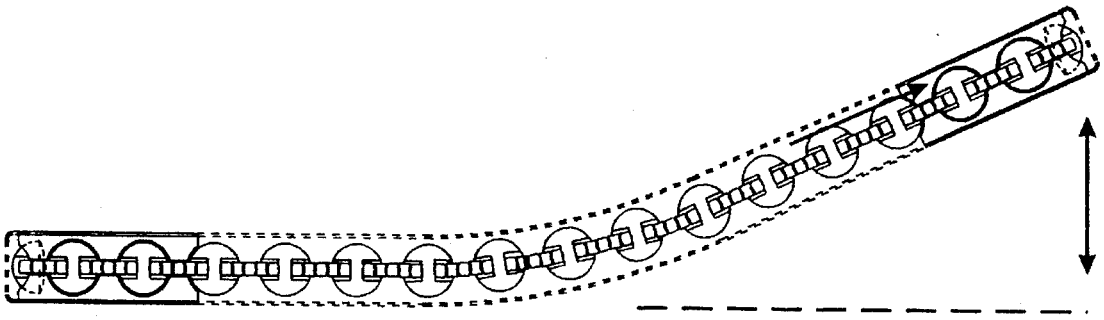
FIG. 18 is a side elevation of the direct drive means device.

FIG. 16 shows the device as used within a housing 126. The device may be used within, or without, a housing. The device is suited for applications where relatively high torque is to be transferred, and where space is at a premium. If the device is used in the housing, the housing may be flexible as shown in FIG. 18. Again, the interaction of the links and spacers allows the device to be moved within the vertical plane if a flexible housing is used. It should be noted that the embodiment of FIGS. 10 through 18 allows the links to move relative to the cable, since the links are not fixed to the cable, however, the links should not be allowed to rotate as fully as in the embodiment shown in FIG. 2, since too much rotation will prevent proper engagement of the links within the voids of the drive gear.

Figure 19:
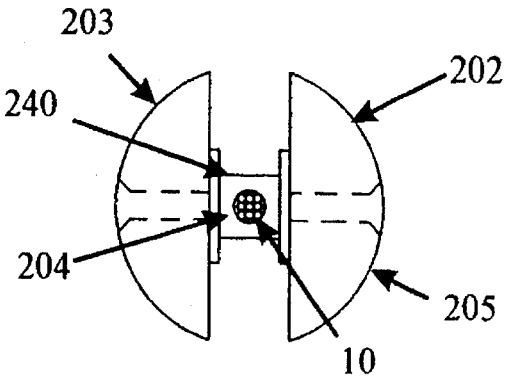
FIG. 19 is a side elevation of a link of a direct drive means.
Figure 20:
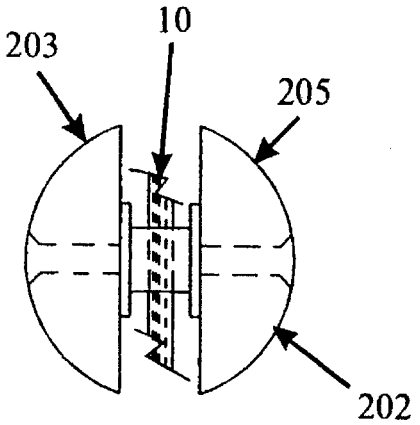
FIG. 20 is a top plan view of a link of a direct drive means.
Figure 21:
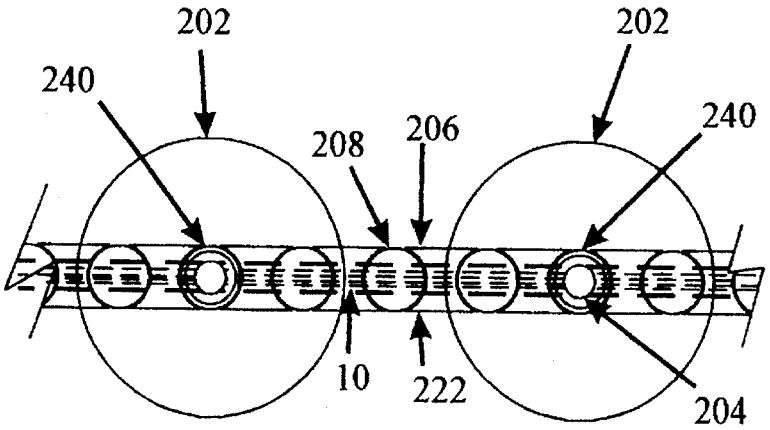
FIG. 21 is a side elevation of a section of a direct drive means, with a cable shown as a phantom.
Figure 22:
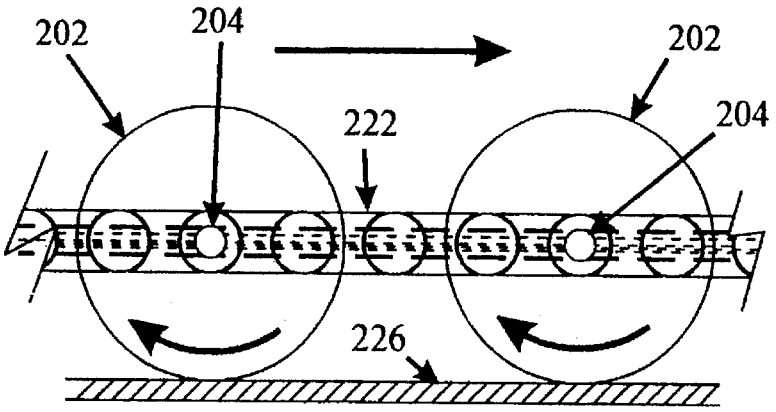
FIG. 22 is the direct drive means of FIG. 21, with arrows indicating a direction of travel of the direct drive means, and rotation of the links.
Figure 23:
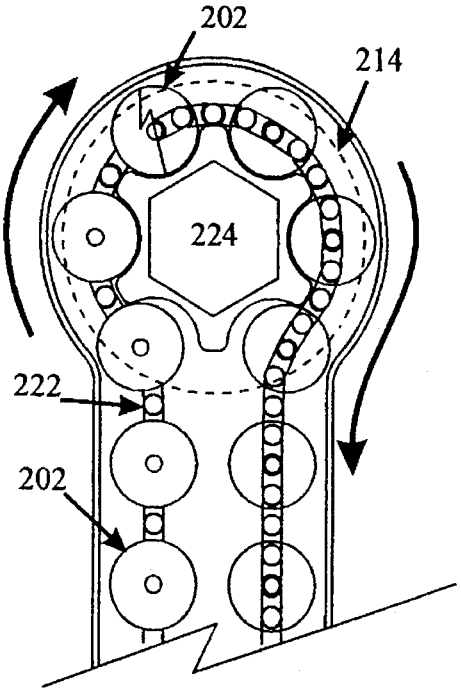
FIG. 23 is an enlarged partial view of a direct drive means.

An additional embodiment of a link 202 is shown in FIGS. 19 and 20. These links are joined by spacers to form a drive means as shown in FIGS. 21 and 22.

The link has a first lobe 203 and a second lobe 205. The lobes may be hemispherical, so that the first lobe and the second lobe form a link which is generally spherical.

The first and second lobe are joined by an axle 240. The axle allows the first lobe and second lobe to rotate about the axle.

The first lobe and the second lobe are joined so that a space is present between the first lobe and the second lobe. A hole or void is formed in the axle through which the cable 10 extends. Spacers 222 are present between the links to maintain desired spacing between the links.

The spacers may be formed by a series of joints. The joints may have alternating convex and concave surfaces which correspond and which provide a bearing surface between the joints. As shown in FIG. 21, joints 206 having a concave surface on each side may alternate with joints 208 which are circular, or which are convex on each side to form the desired surface. Since the axle will, in the preferred embodiment be generally circular when viewed as shown in FIG. 21, the joint on either side will have a concave surface which is adjacent to the axle to provide the bearing surface. As in the previous embodiment, the spacers and links are joined by a continuous loop, or cable. The cable runs through the links and spacers to join the links and spacers, but is independent, that is, the cable is not affixed or attached to the links or cables.

As shown in FIG. 22, in this embodiment, the links will roll relative to a housing or other surface with which the drive means comes in contact. By providing a means for the links to roll, friction within the housing or other environment with the links is substantially reduced. This reduction of friction reduces wear, and also reduces energy loss from friction.

Figure 24:
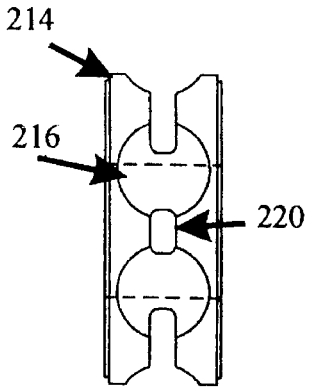
FIG. 24 is a side elevation of a drive gear.
Figure 25:
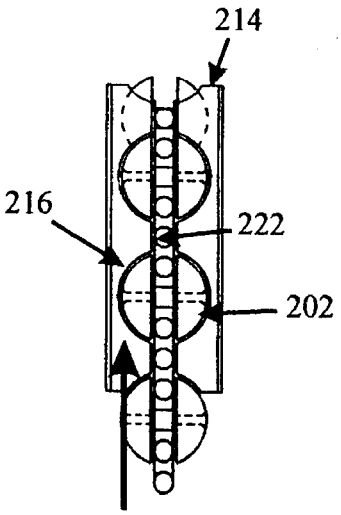
FIG. 25 is the elevation of the drive gear of FIG. 24 demonstrating a direct drive means rotating through the drive gear.
Figure 26:
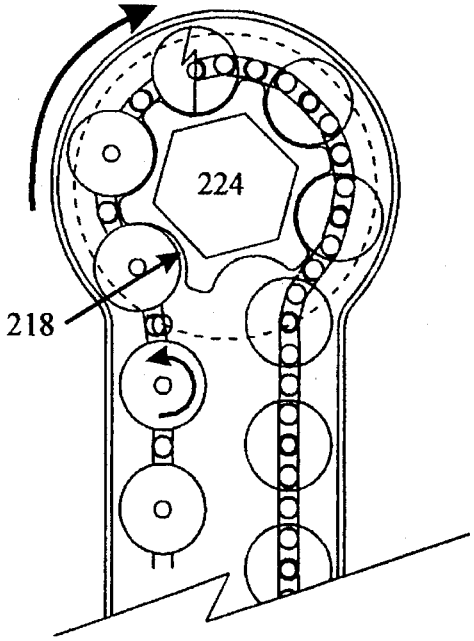
FIG. 26 is an enlarged partial view of the device.

Drive gears are provided which correspond to the drive means. The preferred drive means 214,228 of this embodiment are dimensionally very similar to preferred drive means 14,28 shown in FIGS. 1 through 9, and accordingly, the preferred drive gears are similar in configuration. As shown in FIG. 24, the drive gear will have a generally circular void 216 when viewed as shown in FIG. 24. The links will engage the voids as they rotate through the drive gear as shown in FIG. 25. An orifice 220 is provided which engages the links as the links rotate through the drive gear. It is preferred that the links not extend beyond the outside diameter of the drive as the links are fully engaged in the drive gear, and rotate through the drive gear.

Figure 27:
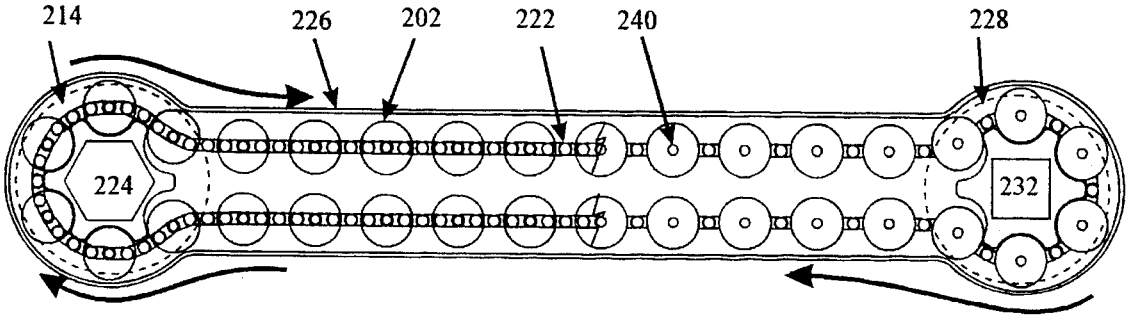
FIG. 27 is a top plan view of the device located in a housing, with the arrows demonstrating a possible direction of rotation.
Figure 28:
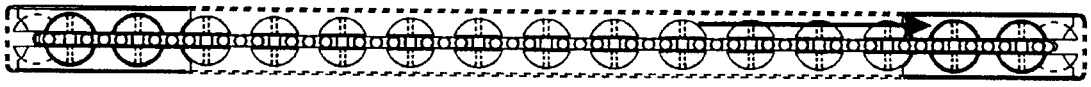
FIG. 28 is a side elevation of the torque transfer device, enlarged from FIG. 27, and showing a housing as a phantom.

As shown in FIG. 27, the device could be placed within a housing 226. In this configuration, the horizontal transfer of torque is taking place. Various means may be provided to the drive gears for the application of torque or the take off of torque from the drive gear.

In use, a gear is rotated by application of torque from another rotating device. The rotating device could be any known tool, including a wrench, ratchet, screwdriver, or a power tool, a motor, or a transmission, or other device which will apply a rotational force to the gear.

As the first gear rotates, the links engage the voids in the gear, and the drive means is pulled in the direction of rotation of the gear, causing a like rotation of the drive means. The spacers engage the orifice of the gear to aid in keeping the drive means properly aligned. The links are engaged and rotate within the gear for somewhat more than 180°, where they are discharged from the gear.

The rotation of the drive means by the first gear causes rotation of the second gear. In this manner, torque is transferred to the second gear. Power take off means may be supplied, and application means, such as a tool, a generator, a pump, or other device which is actuated by the application of torque could be used. For the purpose of increasing or decreasing torque, or increasing or decreasing rotational speed, gears of different effective diameters could be employed, if space permits.

A longitudinally and centrally disposed wall may be placed within the housing, if used, to separate the portions the drive means moving in opposite directions as the gears rotate. The wall may have a lubricant or low frictional quality, by the use of a material such as teflon at the point of contact of the drive means with the wall.

The device may be configured as allowed by the flexible drive means. The housing could be arcuate. An object of the present invention is to provide a device which will transfer torque to a point where there is difficulty in positioning a drive. The use of various shapes, including straight lines and arcs for the housing furthers this object of the invention.

It is not necessary that the gears rotate within the same plane. The application of torque may be directed to position the device to rotate on a plane which is perpendicular to, or otherwise different than, the plane within which the first gear rotates. One or more idler gears could be used to facilitate such directional change.

What is claimed is:

1. A torque transfer device, comprising:

a. a continuous loop direct drive means comprising a plurality of alternating spacers and links which are connected by a continuous cable which extends through each of said links and spacers;

b. a first drive gear and a second drive gear, each comprising an orifice about a circumference thereof which is of sufficient width to allow protrusion there through of the spacers of said direct drive means and in which are defined a plurality of voids of sufficient size to allow protrusion there through of the links of said direct drive means, said voids located around said circumference in such manner that each ink of said direct drive means enters one void as said direct drive means passes through each of said drive gears; and c. a housing in which said first drive gear and said second drive gear are present;

wherein said direct drive means provides communication between said first drive gear and said second drive gear, and wherein a drive means causes rotation of said first drive gear and said direct drive means causes, in turn, rotation of said second drive gear.

2. A torque transfer device as described in claim 1, wherein said cable is not fixed to said links or said spacers and said cable is capable of travel through said plurality of links and spacers.

3. A torque transfer device as described in claim 1, wherein each of said links has a larger surface area than each of said spacers.

4. A torque transfer device as described in claim 2, wherein each of said links has a larger surface area than each of said spacers.

5. A torque transfer device as described in claim 3, wherein each of said links is generally spherical in shape.

6. A torque transfer device as described in claim 4, wherein each of said links is generally spherical in shape.

7. A torque transfer device as described in claim 5, wherein each of said spacers comprises a concave surface on each end thereof which is adjacent to said links.

8. A torque transfer device as described in claim 6, wherein each of said spacers comprises a concave surface on each end thereof which is adjacent to said links.

9. A torque transfer device as described in claim 5, wherein each of said spacers comprises at least two joints, with at least one of said joints having a concave surface on each end thereof and at least one of said joints having a convex surface on at least one end thereof.

10. A torque transfer device as described in claim 6, wherein each of said spacers comprises at least two joints, with at least one of said joints having a concave surface on each end thereof and at least one of said joints having a convex surface on at least one end thereof.

11. A torque transfer device as described in claim 3, wherein each of said links has a concave surface which is adjacent to one of said plurality of voids of said drive gear as each of said links is present within said void as each of said links rotates through said drive gear.

12. A torque transfer device as described in claim 4, wherein each of said links has a concave surface which is adjacent to one of said plurality of voids of said drive gear as each of said links is present within said void as each of said links rotates through said drive gear.

13. A torque transfer device as described in claim 11, wherein each of said spacers comprises a concave arcuate surface on each end thereof which is adjacent to said links.

14. A torque transfer device as described in claim 12, wherein each of said spacers comprises a concave arcuate surface on each end thereof which is adjacent to said links.

15. A torque transfer device as described in claim 11, wherein each of said spacers comprises at least two joints, with at least one of said joints having a concave arcuate surface on each end thereof and at least one of said joints having a convex arcuate surface on at least one end thereof.

16. A torque transfer device as described in claim 12, wherein each of said spacers comprises at least two joints, with at least one of said joints having a concave arcuate surface on each end thereof and at least one of said joints having a convex arcuate surface on at least one end thereof.

17. A torque transfer device as described in claim 3, wherein each of said links has a first lobe and a second lobe, and wherein said first lobe and said second lobe are joined by an axle, and wherein said cable extends through said axle, and wherein said spacers are adjacent to said axle.

18. A torque transfer device as described in claim 4, wherein each of said links has a first lobe and a second lobe, and wherein said first lobe and said second lobe are joined by an axle, and wherein said cable extends through said axle, and wherein said spacers are adjacent to said axle.

19. A torque transfer device as described in claim 5, wherein each of said links is formed of a first hemisphere and a second hemisphere which are joined by an axle, and wherein said cable extends through said axle, and wherein said spacers are adjacent to said axle.

20. A torque transfer device as described in claim 6, wherein each of said links is formed of a first hemisphere and a second hemisphere which are joined by an axle, and wherein said cable extends through said axle, and wherein said spacers are adjacent to said axle.

21. A torque transfer device as described in claim 17, wherein each of said spacers comprises a concave arcuate surface on each end thereof which is adjacent to an axle.

22. A torque transfer device as described in claim 18, wherein each of said spacers comprises a concave arcuate surface on each end thereof which is adjacent to an axle.

23. A torque transfer device as described in claim 17, wherein each of said spacers comprises at least two joints, with at least one of said joints having a concave arcuate surface on each end thereof and at least one of said joints having a convex arcuate surface on at least one end thereof.

24. A torque transfer device as described in claim 18, wherein each of said spacers comprises at least two joints, with at least one of said joints having a concave arcuate surface on each end thereof and at least one of said joints having a convex arcuate surface on at least one end thereof.

25. A torque transfer device as described in claim 19, wherein each of said spacers comprises a concave arcuate surface on each end thereof which is adjacent to an axle.

26. A torque transfer device as described in claim 20, wherein each of said spacers comprises a concave arcuate surface on each end thereof which is adjacent to an axle.

27. A torque transfer device as described in claim 19, wherein each of said spacers comprises at least two joints, with at least one of said joints having a concave arcuate surface on each end thereof and at least one of said joints having a convex arcuate surface on at least one end thereof.

28. A torque transfer device as described in claim 20, wherein each of said spacers comprises at least two joints, with at least one of said joints having a concave arcuate surface on each end thereof and at least one of said joints having a convex arcuate surface on at least one end thereof.

29. A torque transfer device as described in claim 3, wherein each of said links is partially spherical in shape.

30. A torque transfer device as described in claim 4, wherein each of said links is partially spherical in shape.

* * * * *